United States Patent [19]

Yaginuma

[11] 4,137,703

[45] Feb. 6, 1979

[54] TIMER DEVICE

[75] Inventor: Jusuke Yaginuma, Koriyama, Japan

[73] Assignee: Copal Company Limited, Tokyo, Japan

[21] Appl. No.: 810,782

[22] Filed: Jun. 28, 1977

[30] Foreign Application Priority Data

Jun. 30, 1976 [JP] Japan ..... 51-86265[U]

[51] Int. Cl.[2] ..... G04B 24/00

[52] U.S. Cl. ..... 58/16 D; 58/38 R; 58/125 C

[58] Field of Search ..... 58/16 R, 16 D, 19 R, 58/38 R, 125 C, 126 E; 235/1 C

[56] References Cited

U.S. PATENT DOCUMENTS

| | | | |
|---|---|---|---|
| 3,636,699 | 1/1972 | Marble | 58/22 |
| 3,686,879 | 8/1972 | Hummel et al. | 58/38 |
| 3,924,399 | 12/1975 | Robinson | 58/16 D |
| 4,050,232 | 9/1977 | Taguinuma | 58/52 R |

*Primary Examiner*—Robert K. Schaefer
*Assistant Examiner*—Vit W. Miska
*Attorney, Agent, or Firm*—Cushman, Darby & Cushman

[57] ABSTRACT

A timer device wherein a timer cam disk to be moved from a non-operating position to an operating position at a preset time point in cooperation with a timer setting drum is so formed as to be returned to the non-operating position from the operating position at a comparatively higher speed only during a predetermined time period after it is moved from the non-operating position to the operating position in order to prevent the time during which the timer cam disk is maintained in the operating position from becoming unnecessarily long.

3 Claims, 3 Drawing Figures

TIMER DEVICE

BACKGROUND OF THE INVENTION (a) Field of the Invention

The present invention relates to timers and more particularly to improvements in a timer device incorporated in a clock.

(b) Description of the Prior Art

Generally, a conventional timer device wherein, at a preset time point, a timer operates to actuate an alarm or the like and, after a predetermined time period, the operation of said alarm or the like is automatically stopped so that the timer may again return to the state as before the operation comprises a timer cam disk which includes a convex cam having a steep end portion formed on one side and a slow slope formed on the other side and which rotates as synchronized with the time indication of a time indicating portion, and a timer setting drum having a concave cam into which said convex cam can fall, and is arranged so that when the convex cam of the timer cam disk fall into the concave cam of the timer setting drum, the timer may operate to be on and, when the timer cam disk is pushed up by the slope of the convex cam, the timer may operate to be off. In such timer device, as the timer cam disk is rotated as synchronized with the time indicating member which is very slow in the rotation, the time until said timer device operates to be off after it operates to be on, that is, the time until the timer cam disk is completely push up is so long that, particularly in a timer device using a battery as a current source, the alarm or the like is operated for an unnecessarily long time and there has been a defect that the consumption of the battery is so high.

SUMMARY OF THE INVENTION

Therefore, a primary object of the present invention is to provide a timer device wherein a timer cam disk for actuating an alarm or the like is so formed as to rotate at a low speed while it is in a non-operating position (off-position) but to rotate at a comparatively higher speed to be returned again to the non-operating position only during a predetermined time period after it moves to the operating position (on-position).

Another object of the present invention is to provide a timer device wherein the on-operation of a timer is so made as to be able to be made accurately at a preset time point.

According to the present invention, the above mentioned objects can be attained by providing a clutch member rotating at a speed higher than the rotating speed of a timer cam disk and engageable with the timer cam disk so that, when a cam provided on a timer setting drum and a cam provided on the timer cam disk engage with each other, the above mentioned clutch member and timer cam disk may be engaged with each other to rotate the timer cam disk temporarily at a higher speed.

DESCRIPTION OF THE PREFERRED EMBODIMENT

Figure 1:
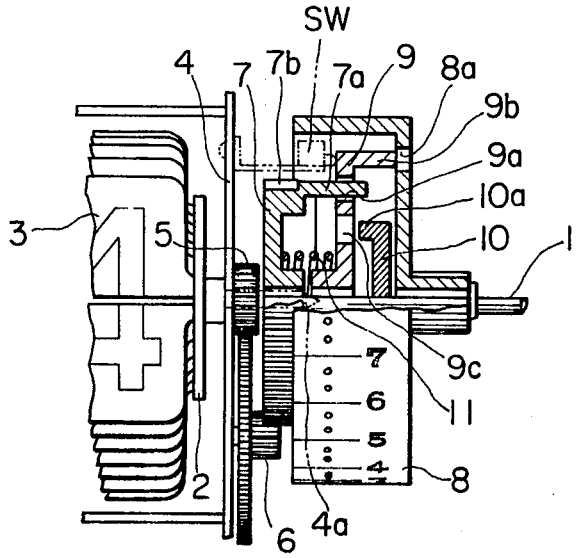
FIG. 1 is a partly sectioned elevational view of a timer device according to the present invention.

Reference numeral 1 designates main shaft rotated by one rotation in an hour by such driving source as a motor rotating as synchronized with the frequency of a commercial current source not illustrated or a motor rotating at a constant speed by using a tuning fork or quartz oscillator as a time basis, 2 designates a drum secured to said main shaft 1, and 3 designates a minute digit plate incorporated with the drum 2 and indicating 0 to 60 minutes in response to one rotation of the main shaft 1. Reference numeral 4 designates a base plate rotatably supporting the main shaft 1, 5 designates a gear secured to the main shaft 1, 6 designates a reduction gear meshing with the gear 5 to reduce the rotation of the main shaft 1 to 1/24, and 7 designates a connecting wheel provided with projections *7a* and a gear portion *7b* and rotatably mounted on the main shaft 1 so that the gear portion *7b* may mesh with the reduction gear 6, reduce the rotation of the main shaft 1 to 1/24 and rotate as synchronized with the time indication of the time indicating portion, 8 designates a timer setting drum provided with time graduations on the outer peripheral surface and a concave cam *8a* on the side surface and rotatable by hand, and 9 designates a timer cam disk provided with peripherally long arcuate slots *9a* engaging respectively with the projections *7a* of the connecting wheel 7, a convex cam *9b* capable of fitting in the concave cam *8a* of the timer setting drum 8 and a plurality of holes *9c* arranged at the same regular intervals, rotatably and axially slidably mounted on the main shaft 1 and rotating as synchronized with the time indicating member by the engagement of the slots *9a* and the projections *7a* of the connecting wheel 7. Reference numeral 10 designates a clutch disk provided with projections *10a* engageable respectively with the holes *9c* of the timer cam disk 9 and secured to the main shaft, and 11 designates a spring for always pressing the timer cam disk 9 toward the timer setting drum 8.

Figure 2:
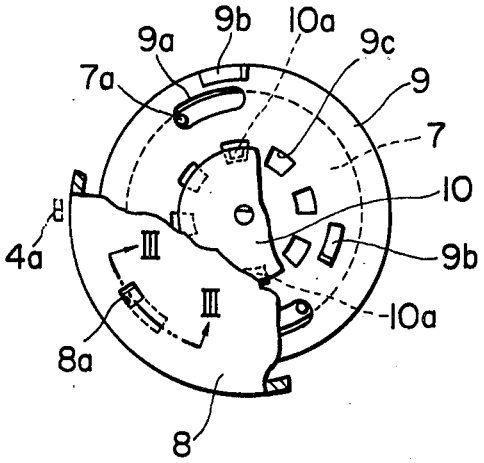
FIG. 2 is a right side view of FIG. 1 shown as partly sectioned.
Figure 3:
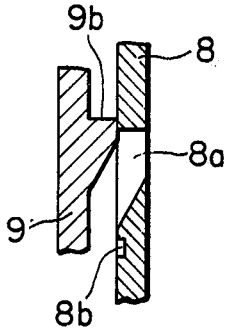
FIG. 3 is an enlarged sectional view along line III—III in FIG. 2.

The operation of the timer device formed as described above shall be explained in the following. When the timer setting drum 8 is rotated by hand to set any desired time graduation at a fixed pointer *4a* and then, in response to the lapse of time, the timer cam disk 9 rotates and operates together with the time indicating member to the set time point, the positions of the concave cam *8a* of the timer setting drum 8 and the convex cam *9b* of the timer cam disk 9 will coincide with each other, the positions of the holes *9c* of the timer cam disk 9 and the projections *10a* of the clutch disk 10 will coincide respectively with each other, the timer cam disk will be pushed by the spring 11 to slide rightward in the drawing and such starting element as a microswitch SW will be operated by this operation to actuate an alarm or the like. Now, in the timer cam disk 9 of this embodiment, as eight holes *9c* engaging respectively with the projections *10a* of the clutch disk 10 are provided on the entire periphery, the timer operating time setting graduations of this timer device are graduations at intervals of at least 7 minutes 30 seconds. Thus, in the operation after the timer operates to be on, as the clutch disk 10 is secured to the main shaft 1 rotating at a speed (one rotation in an hour) higher than the rotating speed (one rotation in 24 hours) of the timer cam disk 9, the timer cam disk 9 will be rotated at a higher speed by an angular range in which the slots *9a* of the timer cam disk 9 are rotatable relatively with the respective projections 7*a* of the connecting wheel 7 by the projections 10*a* of the clutch disk 10 engaged respectively with the holes 9*c* of the timer cam disk 9 and, by this rotation, the convex cam 9*b* of the timer cam disk 9 will be slid up on the slope of the concave cam 8*a* of the timer setting drum 8 and the timer cam disk 9 will return to the position shown in FIG. 1. In this state, the rotation of the timer cam disk 9 will stop but the connecting wheel 7 will continue to rotate at a speed of one rotation in 24 hours. When the connecting wheel 7 rotates by the rotation angle rotated at the higher speed by the above described clutch disk 10, the projections 7*a* of the connecting wheel 7 will again contact the respective end surfaces of the slots 9*a* of the timer cam disk 9 and will rotate the timer cam disk 9. The concavity 8*b* of the timer setting drum 8 shown in FIG. 3 serves to temporarily lock the tip of the convex cam 9*b* of the timer cam disk 9 so that the projections 7*a* of the connecting wheel 7 may move respectively within the slots 9*a* of the timer cam disk 9 to positively contact the respective end portions of the slots 9*a*. Therefore, even in case the timer setting drum 8 is rotated to set the next timer on-operation time just after the on-operation of the timer, the tip of the above mentioned convex cam 9*b* will temporarily engage with the above mentioned concavity 8*b*, the timer cam disk 9 will be rotated counterclockwise in FIG. 2 and, as a result, the projections 7*a* will positively contact the respective end portions of the slots 9*a*.

By the way, in this embodiment, even if the concavo-convex relations of the projection 7*a* of the connecting wheel 7 and the slot 9*a* of the timer cam disk 9, of the concave cam 8*a* of the timer setting drum 8 and the convex cam 9*b* of the timer cam disk 9 and of the projection 10*a* of the clutch disk 10 and the concavity 9*c* of the timer cam 9 are respectively reversed with each other, exactly the same operations and effects will be obtained.

What is claimed is:

1. A timer device comprising a timer setting drum having a cam portion on its side surface, a timer cam disk arranged adjacently to said timer setting drum and having therein a cam portion engageable with the cam portion of said timer setting drum and capable of axially moving to actuate an alarm or the like when the cam portion of said timer cam disk and the cam portion of said timer setting drum engage with each other, a clutch disk arranged between said timer setting drum and timer cam disk and engageable with said timer cam disk and rotating at a speed higher than the rotation of said timer cam disk, and a connecting wheel means arranged adjacently to said timer cam disk and capable of transmitting the rotation of a time indicating member to said timer cam disk and connected with said timer cam disk by pin-slot connection so as to be able to rotate independently of said timer cam disk by a rotation angle necessary to disengage the cam portion of said cam disk from the cam portion of said timer setting drum, said timer cam disk and said clutch disk being engaged with each other simultaneously with the engagement of the cam portion of said timer setting drum and the cam portion of said timer cam disk with each other, and the cam portion of said timer setting drum and the cam portion of said timer cam disk being disengaged with each other by the rotation of said clutch disk.

2. A timer device according to claim 1 wherein said timer setting drum as a means for temporarily locking said timer cam disk thereon.

3. A timer device according to claim 1 wherein said timer setting drum, the timer cam disk, clutch disk and connecting means are concentrically arranged, and said timer cam disk, clutch disk and connecting wheel means are incorporated within said timer setting drum.

* * * * *